United States Patent [19]

Block

[11] Patent Number: 4,662,770

[45] Date of Patent: May 5, 1987

[54] PRESSURE SENSITIVE REINFORCEMENT TAPE FOR LOOSE LEAF SHEET

[75] Inventor: George Block, Park Ridge, Ill.

[73] Assignee: Carstens Health Industries, Inc., Chicago, Ill.

[21] Appl. No.: 658,895

[22] Filed: Nov. 30, 1984

[51] Int. Cl.[4] ..... B42F 13/00; B42D 1/00

[52] U.S. Cl. ..... 402/80 R; 281/2; 281/5; 402/79

[58] Field of Search ..... 281/1, 2, 5; 282/1 R, 282/1 A, 2, 3 R; 283/1 R, 1 A, 61, 62, 81; 402/80 R, 79

[56] References Cited

U.S. PATENT DOCUMENTS

| | | | |
|---|---|---|---|
| 1,747,256 | 2/1930 | McMillan | 402/79 |
| 1,769,395 | 7/1930 | Selden | 402/79 |
| 1,843,771 | 2/1932 | Kline | 402/79 |
| 2,039,752 | 5/1936 | Thomas | 402/79 |
| 2,049,030 | 7/1936 | Strauss | 206/57 |
| 2,086,126 | 7/1937 | Gilchrist | 91/68 |
| 2,089,469 | 8/1937 | Dix | 154/42 |
| 2,095,437 | 10/1937 | Fox | 40/2 |
| 2,400,995 | 5/1946 | Humphner | 117/122 |
| 2,500,549 | 3/1950 | Ketay et al. | 206/59 |
| 2,565,509 | 8/1951 | Marcin | 154/118 |
| 2,589,168 | 3/1952 | Vassar | 206/59 |
| 2,764,501 | 9/1957 | Perri | 117/25 |
| 3,176,891 | 4/1965 | Goldsholl | 283/62 X |
| 3,315,683 | 4/1967 | Rodriquez et al. | 402/79 |

FOREIGN PATENT DOCUMENTS

| | | | |
|---|---|---|---|
| 1165258 | 10/1958 | France | 402/79 |
| 2521911 | 8/1983 | France | 402/79 |
| 57-10073 | 6/1982 | Japan | 402/79 |

*Primary Examiner*—Paul A. Bell

*Attorney, Agent, or Firm*—Schoenberg, Fisher & Newman, Ltd.

[57] ABSTRACT

A reinforcement tape for a loose leaf sheet comprises a strip of plastic tape coated with a pressure sensitive adhesive and includes a plurality of holes configured for alignment with different standard mounting hole configurations and is sized to fit within the confines of the sheet.

9 Claims, 4 Drawing Figures

PRESSURE SENSITIVE REINFORCEMENT TAPE FOR LOOSE LEAF SHEET

BACKGROUND OF THE INVENTION AND PRIOR ART

This invention relates in general to reinforcement devices for loose leaf sheets and the like and particularly to pressure sensitive reinforcement devices.

Many devices are available in the prior art for strengthening the mounting holes of loose leaf papers and other types of removable record sheets. A very common reinforcement consists of doughnut-shaped pieces of fabric or plastic, coated with adhesive on one side, that are individually positioned around each mounting hole to strengthen the surrounding paper material. There are also especially manufactured reinforced loose leaf sheets having plastic material or metal joined along the vertical mounting edge of the sheet and incorporating mounting holes therein. Such special loose leaf sheets are very expensive and, consequently, not in general use.

In certain environments, notably hospitals and institutions, there is a great need for loose leaf records. The record sheets and charts are generally pre-printed and may include one or more mounting hole arrangements to enable their use in different loose leaf binder configurations. Some of the record sheets are designed to be top mounted, that is, horizontally along the upper edge of the sheet. Typical loose leaf binder mounting arrangements include three holes and five holes. There are also two-hole arrangements for use with popular flat metal clamps. The wear and tear to which these record sheets are subject in an institutional environment has given rise to a need for a low-cost, easily-applied device for reinforcing the mounting holes in such sheets. The prior art hole mounting reinforcement devices are for use with an individual hole, difficult to use and not convenient for the various configurations of binders available.

OBJECTS OF THE INVENTION

Accordingly, the principal object of the invention is to provide a low cost reinforcement device for loose leaf sheets.

A further object of the invention is to provide an easily-applied low-cost mounting hole reinforcement device for use with a number of loose leaf sheet mounting configurations.

A further object of the invention is to provide a novel reinforcement device for loose leaf sheets.

SUMMARY OF THE INVENTION

In accordance with the invention, a mounting hole reinforcement device for use with a loose leaf sheet having pre-punched mounting holes along a supporting edge includes a narrow strip of reinforcement tape having a length substantially equal to the length of the supporting edge and defining a plurality of holes positioned to accommodate the pre-punched mounting holes. The tape has an edge-to-hole center distance that is equal to or less than the edge-to-hole center distance of the sheet and includes pressure adhesive means on one side for affixing the sheet along the supporting edge with at least some of the holes in alignment with the pre-punched mounting holes.

BRIEF DESCRIPTION OF THE DRAWINGS

These and other objects of the invention will be apparent upon reading the following description in conjunction with the drawing in which.

DESCRIPTION OF THE PREFERRED EMBODIMENT

Figure 1:
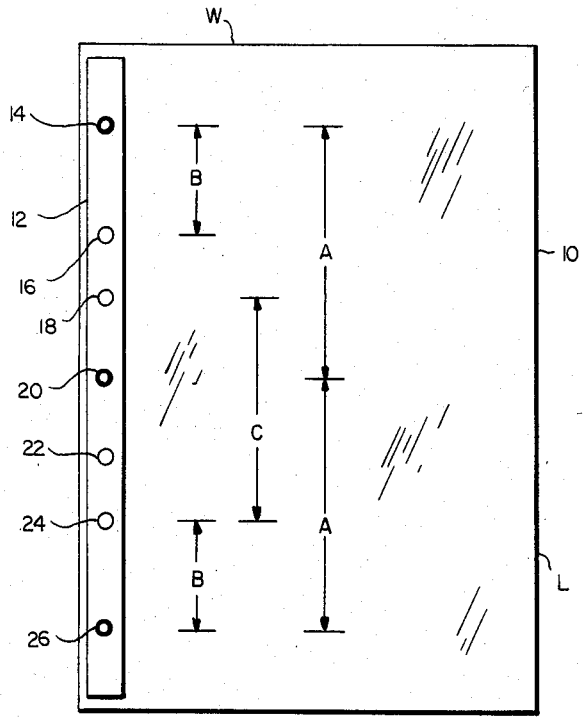
FIG. 1 is a plan view of a loose leaf sheet and an applied reinforcement tape constructed in accordance with the invention.

Referring to FIG. 1, a loose leaf sheet 20 having a width W and a length L is shown with a reinforcement tape 12 vertically affixed along the left side thereof. Tape 12 includes a plurality of centrally disposed non-uniformly spaced holes therealong, each of a diameter equal to or slightly greater than the corresponding diameter of the pre-punched mounting holes along the edge of sheet 10. For the purpose of description, sheet 10 is assumed to have three mounting holes along its left hand edge corresponding to holes 14, 20 and 26 in tape 12. As indicated by the dimension lines, the distance between hole 14 and hole 20 is "A" as is the distance between hole 20 and hole 26. The distance "A" is selected to correspond to the standard three-hole mounting arrangement for ring binders, namely 4.25 inches for a standard $8\frac{1}{2}'' \times 11''$ sheet.

Holes 14, 20 and 26 are indicated by heavy lines to illustrate that they overlie corresponding mounting holes in sheet 10. Tape 12 also includes additional holes 16, 18, 22 and 24 spaced apart distances selected to conform to different standard mounting hole configurations. Thus the distance "B" between holes 14 and 16 and between holes 24 and 26 is equal to 2.0 inches. The configuration of holes 14, 16, 20, 24 and 26 corresponds to the hole spacing in a standard five-hole ring binder. Similarly, the distance between holes 18 and 24, indicated by "C" is 2.75 inches and corresponds to a standard two-hole metal clamp spacing. It will be appreciated that for the three-hole mounting arrangement for sheet 10 illustrated, holes 16, 18, 22 and 24 in tape 12 do not correspond to any holes in sheet 10.

Figure 2:
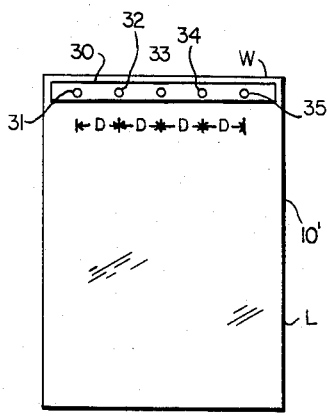
FIG. 2 is a plan view of a loose leaf sheet with another form of the reinforcement tape of the invention.

In FIG. 2 a top mounting arrangement for a sheet 10 of width W and length L is illustrated. A reinforcement tape 30 is positioned along the top (W) of sheet 10 and has five equally spaced holes 31, 32, 33, 34 and 35 spaced a distance "D" of 1.375 inches and corresponds to the standard spacing for the two-hole flat metal clamp mentioned previously as well as three and five-hole top edge binder configurations for a standard $8\frac{1}{2} \times 11''$ sheet.

Figure 3:
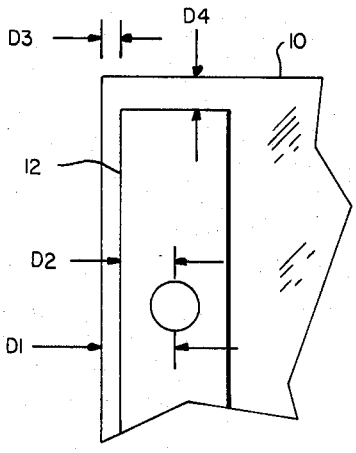
FIG. 3 is a partial view of a section of the reinforcement strip and sheet.

As best illustrated in FIG. 3, each of the tapes has a length that is slightly less than the length of the supporting edge of the corresponding loose leaf sheet and a width that is equal to or less than twice the hole center-to-paper edge distance. The tape, therefore, does not overlap the sheet in any way. The tape, which is preferably fabricated of thin, strong plastic, is coated on one side with a pressure sensitive adhesive. Dimensioning the tape as described thus precludes the adhesive surface of the tape from being exposed when the reinforcement tape is positioned in overlying relationship with the mounting holes in the paper. Simply put, the tape is configured such that it never extends beyond the confines of the sheet to expose the adhesive surface to other sheets or objects. As illustrated, D1 is the pre-punched mounting hole center-to-paper edge distance, D2 is the hole center-to-edge distance of the tape, D3 is the difference between D1 and D2, and D4 is the distance between the end of the tape and the closest adjacent edge of the sheet. Distances D3 and D4 provide margins for precluding the adhesive side of the tape from being exposed to other sheets or objects.

Figure 4:
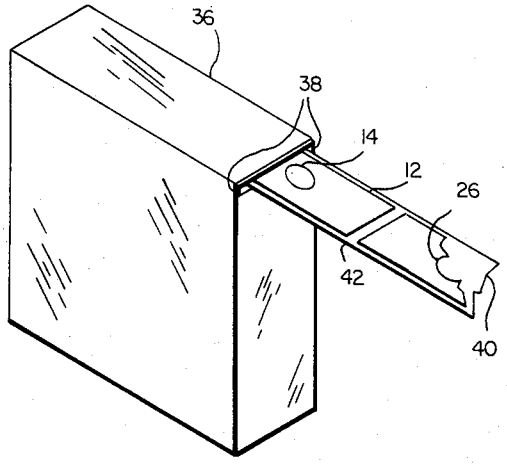
FIG. 4 is a view of a dispensing arrangement for the reinforcement tape of the invention.

The tape may be packaged in a number of ways with a preferred form of dispenser package being illustrated in FIG. 4. A rectangular dispensing box 36 includes a dispensing slot 38 through which extends a paper strip 40 carrying a plurality of reinforcement tape 14, spaced apart at areas 42, only one of which is illustrated. The paper strip includes a non-stick surface to which the adhesive side of reinforcement tapes 14 are temporarily adhered. This is a common carrying arrangement for adhesive backed tapes, labels and the like. The tape and backing paper are coiled into a roll form within the dispensing box. The backing paper is readily torn at areas 42 to enable a single tape 14 to be peeled away for use. Obviously different tape configurations are required for top and side mounting hole reinforcement and separate packages are provided therefor. While the packaging configuration illustrated is preferred, other mounting arrangements will readily suggest themselves to those skilled in the art.

What has been described is a novel reinforcement tape for use with a loose leaf sheet that is low cost, effective and easy to apply. It is recognized that numerous modifications and changes in the described embodiment of the invention will be apparent to those skilled in the art without departing from its true spirit and scope. The invention is to be limited only as defined in the claims.

What is claimed is:

1. A reinforcement device for use with loose leaf sheets having a predetermined pattern of pre-punched mounting holes along an edge of predetermined length comprising; a plurality of individual plastic tapes, each of said individual tapes having a plurality of holes symmetrically arranged with respect to the longitudinal axis of the tapes, at least some of said holes coinciding with said predetermined pattern of mounting holes, each of said individual plastic tapes having a length equal to or less than the predetermined length of the sheet edge; and pressure sensitive adhesive means on one side of said tapes and a singular non-stick backing sheet upon which said plurality of said tapes are longitudinally dispossed with a space between adjacent tapes.

2. The reinforcement device of claim 1 further including a box dispenser having an exit slot, said non-stick backing and said tapes being located in said box dispenser with one end of said backing protruding through said slot.

3. A mounting hole reinforcement device for use on a loose leaf sheet of a given length and having one or more standard patterns of pre-punched mounting holes along a supporting edge thereof, comprising: a narrow strip of tape having a length equal to or less than the given length of the supporting edge and defining a plurality of holes arranged in patterns corresponding to standard three and five ring binders and two hole clamps and pressure sensitive adhesive means on one side of said tape to be affixed to the sheet along the supporting edge with at least some of said plurality of holes in alignment with the pre-punched mounting holes.

4. The reinforcement device of claim 3 wherein said tape is substantially symmetrical about a longitudinal axis.

5. The reinforcement device of claim 4 wherein said tape is fabricated of thin plastic.

6. The reinforcement device of claim 5 wherein there are seven holes in said tape and wherein the spacing between each successive pair of holes is 2", $\frac{1}{8}$", $1\frac{3}{8}$", $1\frac{3}{8}$", $\frac{1}{8}$" and 2".

7. The reinforcement device of claim 5 wherein said narrow strip of tape has a length less than 8" and wherein said tape has five holes each spaced $1\frac{3}{8}$" apart.

8. A reinforcement device for use with standard loose leaf sheets of a given length having one or more standard patterns of pre-punched mounting holes inwardly displaced from a supporting edge comprising;

a plurality of plastic tapes, each having a plurality of holes symmetricaly arranged with respect to the longitudal axis of the tapes, said holes coinciding with standard three and five ring binder and two hole clamp patterns, each of the said tapes having a length equal to or less than the given length of the supporting edge;

a non-stick backing upon which said tapes are longitudinally disposed with a space between adjacent tapes, said backing having a width dimension that is greater than the width of said tapes;

pressure sensitive adhesive means on one side of said tapes, and said backing and said tapes being configured in a roll.

9. The reinforcement device of claim 8 further including a box dispenser having an exit slot, said non-stick backing and said tapes being located in said box dispenser with one end of said backing protruding through said slot.

* * * * *